US005428425A

United States Patent [19]

Miyamoto

[11] Patent Number: 5,428,425

[45] Date of Patent: Jun. 27, 1995

[54] AUTOMATIC DENSITY ADJUSTING DEVICE IN COPYING MACHINE

[75] Inventor: Naruyuki Miyamoto, Osaka, Japan

[73] Assignee: Mita Industrial Co., Ltd., Japan

[21] Appl. No.: 165,923

[22] Filed: Dec. 14, 1993

[30] Foreign Application Priority Data

Dec. 24, 1992 [JP] Japan ..... 4-344824
Dec. 24, 1992 [JP] Japan ..... 4-344825

[51] Int. Cl.[6] ..... G03G 15/04

[52] U.S. Cl. ..... 355/208; 355/243; 355/69

[58] Field of Search ..... 355/208, 214, 243, 69, 355/228

[56] References Cited

U.S. PATENT DOCUMENTS 4,542,985 9/1985 Honma et al. ..... 355/69
4,619,520 10/1986 Araya ..... 355/214
4,627,713 12/1986 Abuyama ..... 355/214 X
4,640,603 2/1987 Honma ..... 355/214
5,043,766 8/1991 Oushiden et al. ..... 355/243 X
5,274,421 12/1993 Takahashi ..... 355/69

*Primary Examiner*—Joan H. Pendegrass
*Attorney, Agent, or Firm*—Beveridge, DeGrandi, Weilacher & Young

[57] ABSTRACT

In an automatic density adjusting device in a copying machine, the width of variation in exposure intensity in relation to the change in a density correction value or magnification manually set is set to a large width if a document is dark, while being set to a small width if the document is light. Accordingly, exposure intensity corresponding to the density correction value or the magnification can be increased or decreased with respect to the light document and the dark document. Consequently, it is possible to always make the most suitable automatic density adjustment irrespective of whether the document is light or dark.

10 Claims, 6 Drawing Sheets

AUTOMATIC DENSITY ADJUSTING DEVICE IN COPYING MACHINE

BACKGROUND OF THE INVENTION

1. Field of the Invention

The present invention relates to an automatic density adjusting device in a copying machine which is so adapted as to allow copying at proper density by automatically detecting the brightness of a document to change exposure intensity or the like.

2. Description of the Prior Art

Conventionally, a copying machine with an automatic density adjusting function has been provided and has spread widely. The copying machine with an automatic document adjusting function has the advantage that time and labor required to manually set image density can be omitted to allow copying at proper density simply by a person which is not accustomed to operating the copying machine.

This automatic document adjusting function is one of illuminating and scanning (pre-scanning) a document once prior to copying operations to detect the brightness of the document, automatically calculating exposure intensity, the amount of charges or the amount of developing bias (hereinafter represented by "exposure intensity") which correspond to the detected brightness of the document on the basis of a predetermined relational expression and illuminating the document depending on the exposure intensity to obtain copies having proper density.

There has been also a method of reading the brightness of a document while illuminating the document without pre-scanning the document and calculating exposure intensity or the like most suitable for the brightness of the document at each time point.

In the above described copying machine with an automatic document adjusting function, the automatic document adjusting function as well as the conventional manual density setting function are made use of so that the automatic document adjusting function is performed when a user selects automatic document adjustment, while the manual density setting function is performed when the user selects manual setting (for example, a copying machine DC2520 manufactured by Mita Industrial Company, Ltd.).

Meanwhile, a copying machine making automatic document adjustment by omitting the manual density setting function has been recently considered. In such a copying machine, there is no manual density setting function, thereby to make it impossible to obtain copies having density depending on a user taste. Therefore, the copying machine is provided with a "density correcting function" of setting the image density to higher density or lower density depending on the user taste without setting to a one-to-one relationship between the brightness of the document and the most suitable exposure intensity or the like to a one-to-one relationship at the time of making the automatic document adjustment.

In such a density correcting function, it is generally considered that density correction curves in the shape of a straight line as shown in FIG. 2 are employed so as to make density corrections. In FIG. 2, the horizontal axis indicates density correction values, and the vertical axis indicates exposure intensity. When there is no density correction (the density correction value =0), exposure intensity to a newspaper which is representative of a dark document is expressed by $I_1$, and exposure intensity to an NTC (New Test Chart) which is representative of a light document is expressed by $I_2$. It goes without saying that a density correction curve which is intermediate between the curves is applied to a document of arbitrary brightness between the newspaper and the NTC.

If density corrections are made using the above described density correction curves, the difference between the exposure intensity to the newspaper and the exposure intensity to the NTC is always kept constant.

If the above described density correction curves are employed, the following problems arise.

Specifically, if the light document such as the NTC and the dark document such as the newspaper are subjected to density corrections, the exposure intensity to the light document and the exposure intensity to the dark document are changed while maintaining the same difference therebetween. Accordingly, the difference in density of a copy image hardly appears with respect to the dark document. That is, the document image is not too light even if the dark document is subjected to a "lighter" density correction, while the document image is not too dark even if the dark document is subjected to a "darker" density correction. This is caused by nonlinear characteristics of a photosensitive material or a developing agent. On the other hand, if the slope of the straight line is increased so that the difference in density of the copy image clearly appears with respect to the dark document, the light document is too light or too dark this time.

Furthermore, the copying machine is generally provided with a magnification setting function of manually setting magnification.

The magnification setting function is achieved by changing the position of a lens for directing a document image to a photoreceptor. However, the brightness of the image is inevitably changed as the magnification is changed. Accordingly, the change in density of this image must be corrected. Also in this case, therefore, the copying machine must be provided with a "density correcting function".

Conventionally, a density correction curve as shown in FIG. 4 has been generally employed. In FIG. 4, the horizontal axis indicates magnification (%), and the vertical axis indicates exposure correction values. Exposure intensity in a case where magnification is 100% is used as the basis, to increase the exposure intensity if the magnification is increased, while decreasing the exposure intensity if the magnification is decreased. The rate of the change in the exposure intensity is constant irrespective of the brightness of the document.

If the above described density correction curve is employed, the following problems arise.

Specifically, if the light document such as the NTC and the dark document such as the newspaper are subjected to density corrections at the same slope, the exposure intensity to the light document and the exposure intensity to the dark document are changed while maintaining the same difference therebetween. Therefore, with respect to the dark document, a copy image is liable to be dark if the magnification is increased, while being too light if the magnification is decreased. This is caused by nonlinear characteristics of a photosensitive material or a developing agent. On the other hand, if an attempt to cause the dark document to have proper density is made, an image of the light document is too light when the magnification is high, while being too dark when the magnification is low this time.

Consequently, an attempt to realize correct density corrections in the copying machine with an automatic document adjusting function or a magnification setting function makes the shape of a density correction curve important.

SUMMARY OF THE INVENTION

An object of the present invention is to provide, in a copying machine for automatic density adjustment only, an automatic document adjusting device in the copying machine capable of making the most suitable density correction depending on the brightness of a document.

Another object of the present invention is to provide, in a copying machine with an automatic document adjusting function and a magnification setting function, an automatic document adjusting device in the copying machine capable of making the most suitable density correction depending on magnification and the brightness of a document.

The automatic document adjusting device in the copying machine according to the present invention for attaining the above described object can manually set image density automatically set depending on the brightness of the document to density on the higher or lower side. The image density is determined on the basis of a density correction value manually set and the measured brightness of the document. In this case, the width of variation in the image density in relation to the change in the density correction value is set to a large width if the document is dark, while being set to a small width if the document is light.

If the document is dark, therefore, the width of variation in the image density in relation to the change in the density correction value is large. Accordingly, a copy image is suitably light if the dark document is subjected to a "lighter" density correction, while being suitably dark if the dark document is subjected to a "darker" density correction. On the other hand, if the document is light, the width of variation in the image density in relation to the change in the density correction value is small. Accordingly, the light document is not too light or dark. Consequently, the most suitable density correction can be always made irrespective of whether the document is dark or light.

The automatic density adjusting device in the copying machine according to the present invention for attaining the above described other object determines image density on the basis of the set magnification and the measured brightness of the document. In this case, the width of variation in the image density in relation to the change in the magnification is set to a large width when the document is dark, while being set to a small width when the document is light.

If the document is dark, therefore, the width of variation in the image density in relation to the change in the magnification is large. Accordingly, a copy image is suitably light if the magnification is increased, while being suitably dark if the magnification is decreased. On the other hand, if the document is light, the width of variation in the image density in relation to the change in the magnification is small. Accordingly, the light document is not too light or too dark. Consequently, the most suitable density correction can be always made depending on the magnification irrespective of the brightness of the document.

Such an automatic document adjusting device in a copying machine has been filed at the Japanese Patent Office (see Japanese Patent Application Serial No. 4-344824 filed Dec. 24, 1992 and Japanese Patent Application Serial No. 4-344825 filed Dec. 24, 1992).

The foregoing and other objects, features, aspects and advantages of the present invention will become more apparent from the following detailed description of the present invention when taken in conjunction with the accompanying drawings.

DETAILED DESCRIPTION OF THE EMBODIMENTS

A. Outline of Copying Machine

Figure 5:
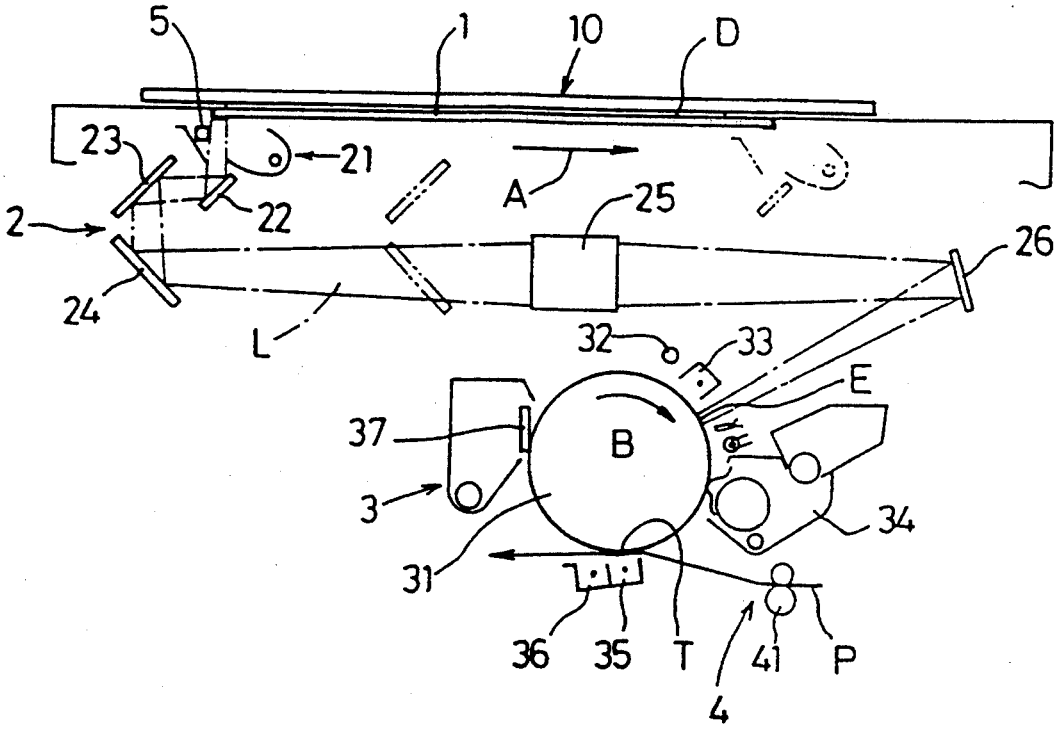
FIG. 5 is a schematic diagram showing the internal construction of a copying machine for automatic exposure only of such a type that an optical system is moved.

FIG. 5 is a schematic diagram showing the internal construction of a copying machine for automatic exposure only of such a type that an optical system is moved. Reference numeral 1 denotes a transparent platen positioned on the upper surface of the main body of the copying machine. An optical system 2 comprising an illuminating lamp 21, plane reflecting mirrors 22, 23 and 24, a lens 25, and a reflecting mirror 26 as well as a light receiving sensor 5 for detecting the intensity of reflected light from a document is disposed in a predetermined position below the transparent platen 1. The above described lens 25 is moved in a direction indicated by an arrow A and in the opposite direction in accordance with the operation of a magnification setting key **8*b* before exposure, and stands still in a suitable position. The illuminating lamp 21 and the plane reflecting mirrors 22, 23 and 24 are moved in the direction indicated by the arrow A, thereby to make it possible to sequentially illuminate and scan a document D. At this time, the illuminating lamp 21 and the plane reflecting mirror 22 are moved integrally with the light receiving sensor 5, and the plane reflecting mirrors 23 and 24 are also moved integrally with the light receiving sensor 5. The moving speed of the illuminating lamp 21 and the plane reflecting mirror 22 is set to twice the moving speed of the plane reflecting mirrors 23 and 24**.

A copying section 3 comprising a photosensitive drum 31 which is rotated in a direction indicated by an arrow B for each copying operation, a charge eliminating lamp 32, a charging corona discharger 33, a developing device 34, a transferring corona discharger 35, a separating corona discharger 36 and a cleaner 37 is disposed below the optical system 2. If the surface of the photosensitive drum 31 uniformly charged by the charging corona discharger 33 is irradiated by reflected light from the document D, an electrostatic latent image is formed. The electrostatic latent image is developed into a toner image by the developing device 34, and the toner image is transferred onto copy paper P by the transferring corona discharger 35. Reference numeral 41 denotes a registration roller constituting a part of a paper conveying section, which conveys the copy paper P at a speed approximately equal to the peripheral speed of the photosensitive drum 31. In addition, reference numeral 10 denotes a document cover mounted rotatably up and down by a hinge mechanism or the like (not shown) so as to cover the upper surface of the transparent platen 1.

B. First Embodiment

Figure 6:
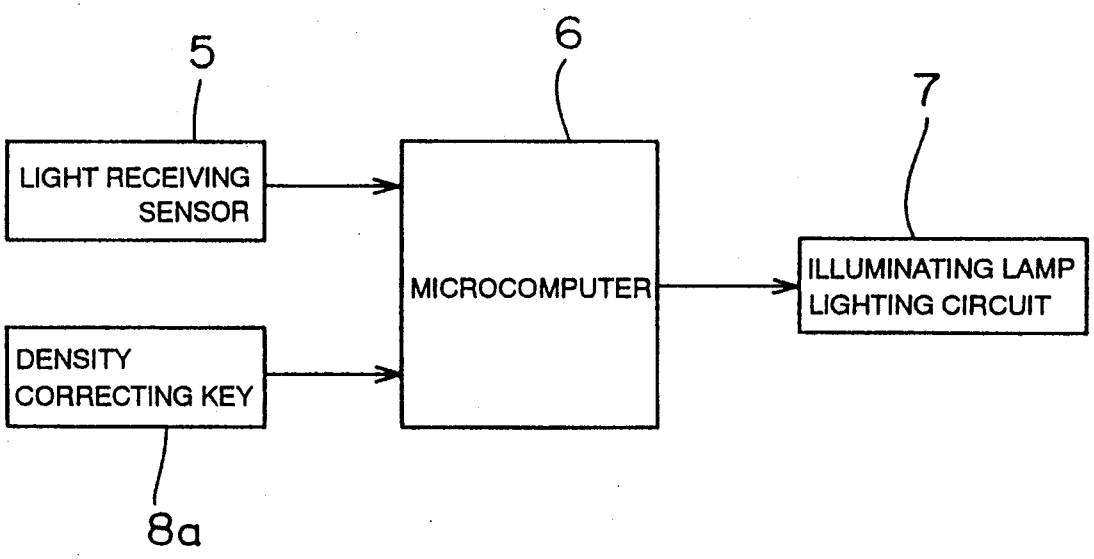
FIG. 6 is a block diagram showing the electrical construction of an automatic density adjusting device according to a first embodiment.

FIG. 6 is a block diagram showing the electrical construction of an automatic document adjusting device in a copying machine according to a first embodiment. In FIG. 6, a reflected light intensity detecting signal from the light receiving sensor 5 is inputted to a microcomputer 6 having a CPU, a RAM, a ROM and the like through an input interface (not shown). In addition, a signal representing a set value of a density correcting key 8*a* for manually setting a density correction value is also inputted to the microcomputer 6. A control signal outputted from the microcomputer 6 is inputted to an illuminating lamp lighting circuit 7 through an output interface (not shown).

Figure 1:
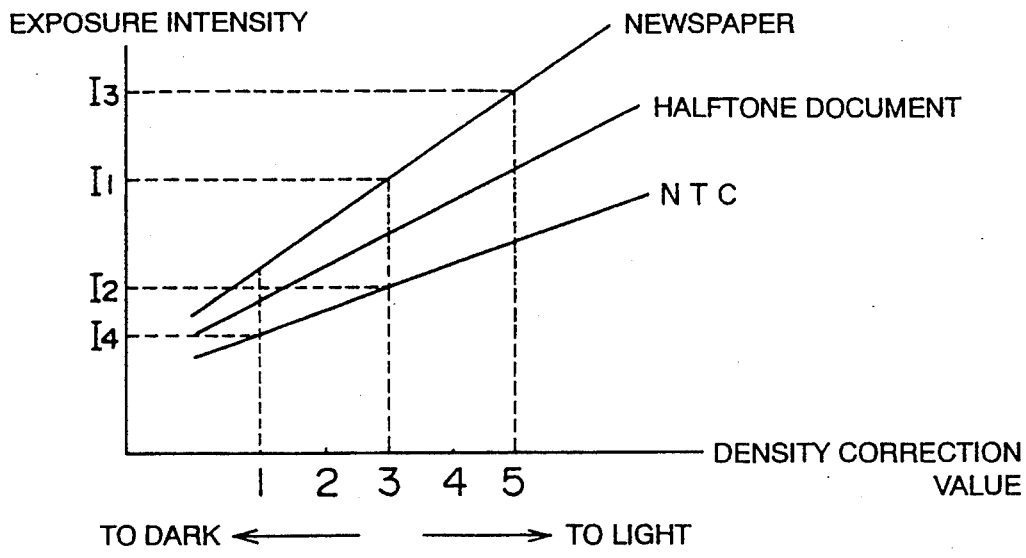
FIG. 1 is a graph showing density correction curves according to the present invention, the horizontal axis and the vertical axis of which respectively indicate density correction values and exposure intensity.
Figure 2:
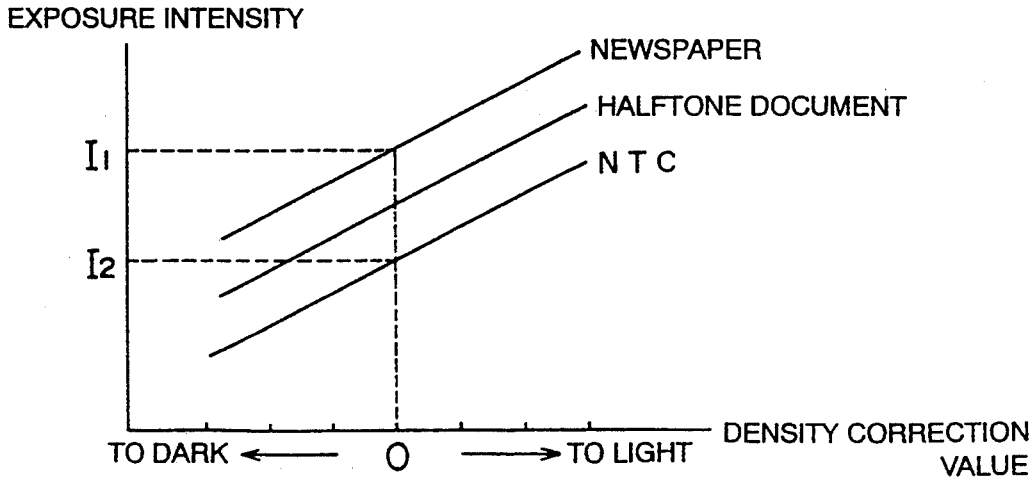
FIG. 2 is a graph showing conventional density correction curves, the horizontal axis and the vertical axis of which respectively indicate density correction values and exposure intensity.

The microcomputer 6 contains a calculation program of a density correction curve whose slope is steep if the document is dark and a density correction curve whose slope is gentle if the document is light on a graph of exposure intensity against density correction values as shown in FIG. 1, and can obtain proper exposure intensity on the basis of this calculation program and output the same.

Description is now made of the procedure for density corrections in the automatic document adjusting device in the copying machine.

Operations in a case where a document which is a newspaper is set on the transparent platen 1 will be described. The microcomputer 6 sets the amount of illumination of the illuminating lamp 21 to an intermediate value to cause the illuminating lamp 21 to illuminate the document, samples reflected light from the front end of the document for a short time (several microseconds) by the light receiving sensor 5, and calculates the average value of the intensity of the sampled light. This average value corresponds to the dark document such as the newspaper. On the other hand, the density correcting key 8*a* is set to any value by a user, and a signal representing the set value is also inputted to the microcomputer 6. The microcomputer 6 applies this density correction value to a curve corresponding to the document which is the newspaper shown in FIG. 1, to obtain proper exposure intensity and output the same. For example, the microcomputer 6 outputs proper exposure intensity $I_1$ if the density correction value is an intermediate value "3", while outputting proper exposure intensity $I_3$ if the density correction value is the maximum value "5".

The amount of illumination of the illuminating lamp 21 is so adjusted that proper exposure intensity can be obtained to scan the optical system 2 in the subsequent exposure.

When a document which is an NTC is then set on the transparent platen 1, the microcomputer 6 samples the brightness of the document as in the foregoing. A value obtained by this sampling corresponds to the light document such as the NTC. On the other hand, the density correcting key 8*a* is set to any value by the user, and a signal representing the set value is also inputted to the microcomputer 6. The microcomputer 6 applies this density correction value to a curve corresponding to the document which is the NTC shown in FIG. 1, to obtain proper exposure intensity and output the same. For example, the microcomputer 6 outputs proper exposure intensity $I_2$ if the density correction value is an intermediate value "3", while outputting proper exposure intensity $I_4$ if the density correction value is the minimum value "1".

The amount of illumination of the illuminating lamp 21 is so adjusted that proper exposure intensity can be obtained to scan the optical system 2 in the subsequent exposure.

C. Second Embodiment

Figure 3:
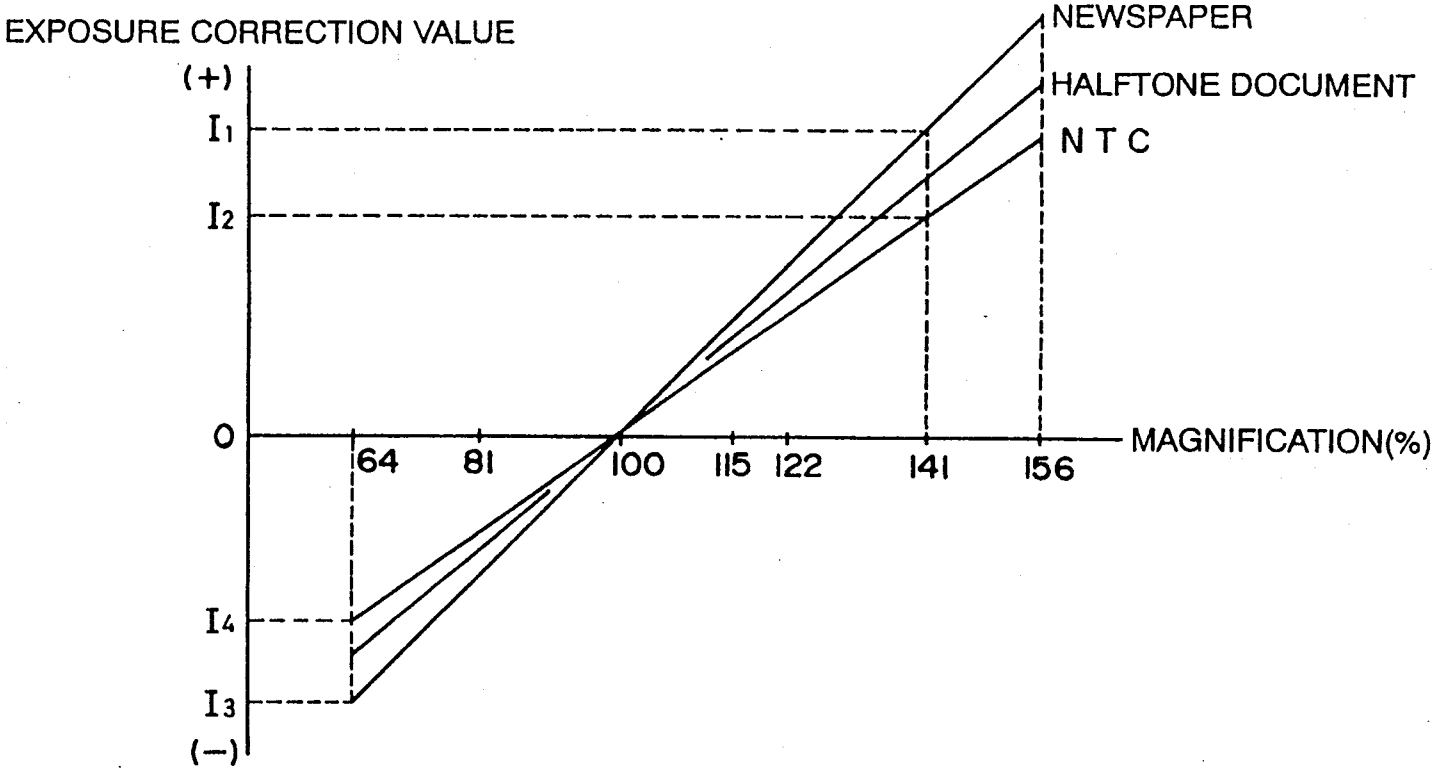
FIG. 3 is a graph showing density correction curves according to the present invention, the horizontal axis and the vertical axis of which respectively indicate magnification and exposure correction values.
Figure 4:
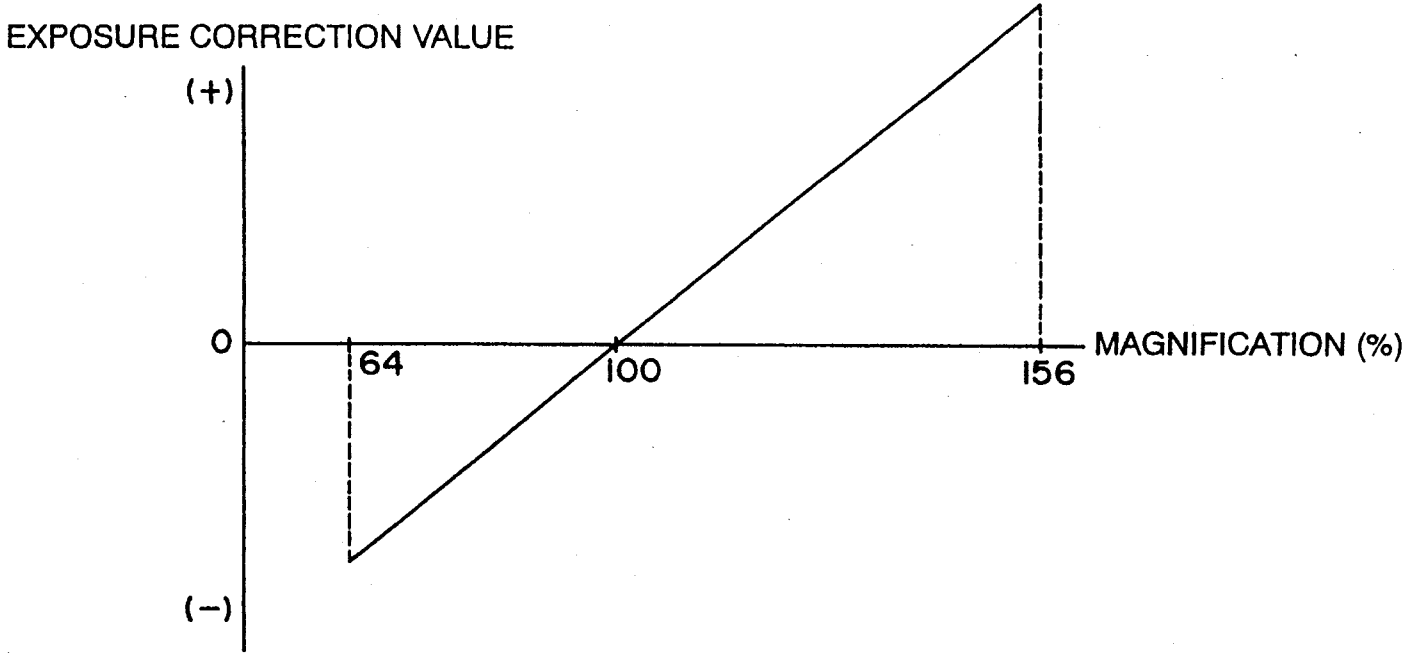
FIG. 4 is a graph showing a conventional density correction curve, the horizontal axis and the vertical axis of which respectively indicate magnification and exposure correction values.
Figure 7:
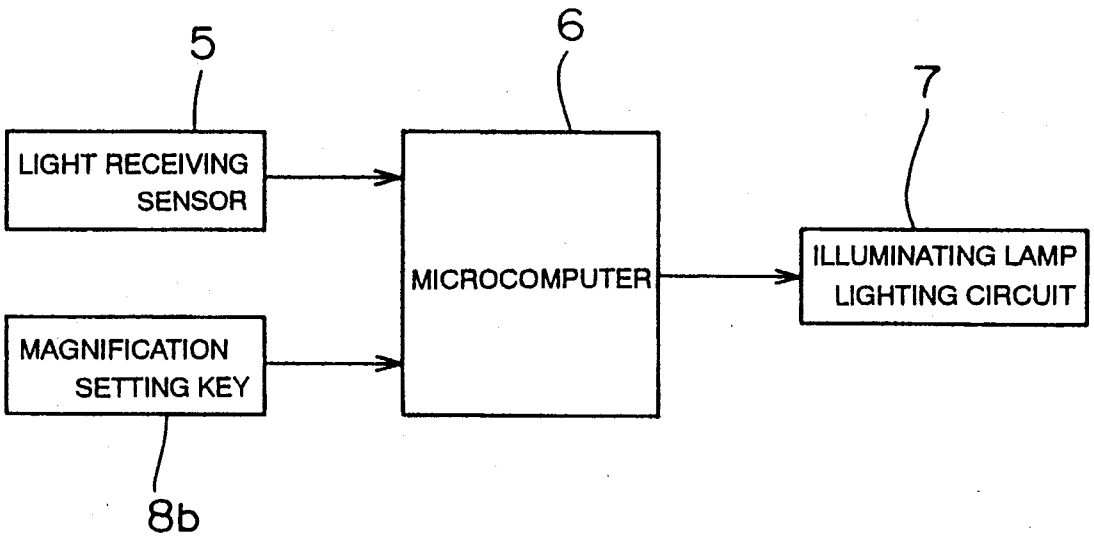
FIG. 7 is a block diagram showing the electrical construction of an automatic document adjusting device according to a second embodiment.

FIG. 7 is a block diagram showing the electrical construction of an automatic document adjusting device in a copying machine according to a second embodiment. A reflected light intensity detecting signal from the above described light receiving sensor 5 and a signal representing a set value of a magnification setting key 8*b* for manually setting magnification are provided to a microcomputer 6 having a CPU, a RAM, a ROM and the like through an input interface (not shown). In addition, a control signal outputted from the microcomputer 6 is inputted to an illuminating lamp lighting circuit 7 through an output interface (not shown). The microcomputer 6 contains a calculation program of a density correction curve which has a large width of variation in an exposure correction value in relation to the change in the magnification if a document is dark and a density correction curve which has a small width of variation in an exposure correction value in relation to the change in the magnification if the document is light, as shown in FIG. 3, and can obtain proper exposure intensity on the basis of this calculation program and output the same.

Description is now made of a density correcting function in the variable magnification copying machine.

Operations in a case where a document which is a newspaper is set on the transparent platen 1 will be described. The microcomputer 6 sets the amount of illumination of the illuminating lamp 21 to an intermediate value to cause the illuminating lamp 21 to illuminate the document, samples reflected light from the front end of the document for a short time (several microseconds) by the light receiving sensor 5, and calculates the average value of the intensity of the sampled light. This average value corresponds to the dark document such as the newspaper. On the other hand, the magnification setting key 8*b* is set to any value by a user, and a signal representing the set value is also inputted to the microcomputer 6. The microcomputer 6 applies this value of magnification to a curve corresponding to the document which is the newspaper shown in FIG. 3, to obtain proper exposure intensity and output the same. For example, if the magnification is 141%, the microcomputer 6 calculates an exposure correction value $I_1$, adds the exposure correction value $I_1$ to exposure intensity in a case where the magnification is 100%, and outputs proper exposure intensity. If the magnification is 64%, the microcomputer 6 calculates an exposure correction value $I_3$, adds the exposure correction value $I_3$ to exposure intensity in a case where the magnification is 100%, and outputs proper exposure intensity.

The amount of illumination of the illuminating lamp 21 is so adjusted that proper exposure intensity can be obtained to scan the optical system 2 in the subsequent exposure.

When a document which is an NTC is then set on the transparent platen 1, the microcomputer 6 samples the brightness of the document as in the foregoing. A value obtained by this sampling corresponds to the light document such as the NTC. On the other hand, the magnification setting key **8*b* is set to any value by the user, and a signal representing the set value is also inputted to the microcomputer 6. The microcomputer 6 applies this value of magnification to a curve corresponding to the document which is the NTC shown in FIG. 3, to obtain proper exposure intensity and output the same. For example, if the magnification is 141%, the microcomputer 6 calculates an exposure correction value $I_2$, adds the exposure correction value $I_2$ to exposure intensity in a case where the magnification is 100%, and outputs proper exposure intensity. If the magnification is 64%, the microcomputer 64** calculates an exposure correction value $I_4$, adds the exposure correction value $I_4$ to exposure intensity in a case where the magnification is 100%, and outputs proper exposure intensity.

The amount of illumination of the illuminating lamp 21 is so adjusted that proper exposure intensity can be obtained to scan the optical system 2 in the subsequent exposure.

D. Another Embodiment

Although in the foregoing description, it is assumed that a document is a newspaper or an NTC, the present invention is not limited to the same. The present invention can cope with a document of arbitrary brightness between the newspaper and the NTC. At that time, a curve corresponding to, for example, a "halftone document" shown in FIG. 1 and FIG. 3 is selected.

Furthermore, although the density correction curves shown in FIG. 1 and FIG. 3 are in the shape of a straight line, the shape of the most suitable density correction curves is determined by tests depending on the characteristics of a photosensitive material and a developing agent. Consequently, the shape is not limited to the shape a straight line. For example, it may, in some cases, be the shape of a non-linear curve.

Although description was made of automatic exposure of the copying machine, the present invention is not limited to the automatic exposure. For example, the present invention is applicable to an automatic density adjusting device for adjusting image density by automatically changing the amount of charges and the amount of developing bias.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An automatic density adjusting device in a copying machine capable of automatically setting proper image density by illuminating a document prior to or at the time of performing copying operations to measure the brightness of the document, comprising:

density correcting means capable of manually correcting the image density automatically set to density on the higher or lower side; and image density determining means for determining the image density on the basis of a density correction value obtained by the density correcting means and the measured brightness of the document, said image density determining means setting the width of variation in the image density in relation to the change in the density correction value to a large width if the document is dark, while setting the width of variation in the image density in relation to the change in the density correction value to a small width if the document is light.

2. The automatic density adjusting device in the copying machine according to claim 1, wherein the image density set by said image density determining means is determined by exposure intensity to the document.

3. The automatic density adjusting device in the copying machine according to claim 1, wherein the image density set by said image density determining means is determined by the amount of charges on a photoreceptor.

4. The automatic density adjusting device in the copying machine according to claim 1, wherein the image density set by said image density determining means is determined by the amount of developing bias in a developing device.

5. The automatic density adjusting device in the copying machine according to claim 1, wherein a graph of the image density against the density correction value is in the shape of a straight line, the slope of the straight line being steep when the width of variation in the image density in relation to the change in the density correction value is large, while being gentle when the width of variation in the image density in relation to the change in the density correction value is small.

6. An automatic density adjusting device in a copying machine capable of automatically setting proper image density by illuminating a document prior to or at the time of performing copying operations to measure the brightness of the document, comprising:

magnification setting means capable of manually setting magnification; and image density determining means for determining the image density on the basis of the set magnification and the measured brightness of the document, said image density determining means setting the width of variation in the image density in relation to the change in the magnification to a large width if the document is dark, while setting the width of variation in the image density in relation to the change in the magnification to a small width if the document is light.

7. The automatic density adjusting device in the copying machine according to claim 6, wherein the image density set by said image density determining means is determined by exposure intensity to the document.

8. The automatic density adjusting device in the copying machine according to claim 6, wherein the image density set by said image density determining means is determined by the amount of charges on a photoreceptor.

9. The automatic density adjusting device in the copying machine according to claim 6, wherein the image density set by said image density determining means is determined by the amount of developing bias in a developing device.

10. The automatic density adjusting device in the copying machine according to claim 6, wherein a graph of the image density against the magnification is in the shape of a straight line, the slope of the straight line being steep when the width of variation in the image density in relation to the change in the magnification is large, while being gentle when the width of variation in the image density in relation to the change in the magnification is small.

* * * * *